US011766860B2

(12) United States Patent
Park et al.

(10) Patent No.: US 11,766,860 B2
(45) Date of Patent: Sep. 26, 2023

(54) METHOD OF CONTROLLING INKJET PRINTING PROCESS

(71) Applicant: STI CO., LTD., Anseong-si (KR)

(72) Inventors: Sang Pil Park, Anseong-si (KR); Kyu Yong Han, Anseong-si (KR); Byoung Hoon Gong, Anseong-si (KR); Young Ho Kim, Anseong-si (KR)

(73) Assignee: STI CO., LTD., Anseong-si (KR)

( * ) Notice: Subject to any disclaimer, the term of this patent is extended or adjusted under 35 U.S.C. 154(b) by 31 days.

(21) Appl. No.: 17/675,495

(22) Filed: Feb. 18, 2022

(65) Prior Publication Data

US 2022/0314603 A1 Oct. 6, 2022

(30) Foreign Application Priority Data

Mar. 30, 2021 (KR) ..... 10-2021-0040858

(51) Int. Cl.
*B41J 2/14* (2006.01)
*B41J 2/045* (2006.01)

(52) U.S. Cl.
CPC ..... *B41J 2/04505* (2013.01); *B41J 2/04551* (2013.01); *B41J 2002/14491* (2013.01)

(58) Field of Classification Search
CPC . B41J 2/16523; B41J 2/04501; B41J 2/04551
See application file for complete search history.

(56) References Cited

U.S. PATENT DOCUMENTS 5,838,343 A * 11/1998 Chapin ..... B41J 2/04 347/42
6,000,781 A * 12/1999 Akiyama ..... B41J 3/54 347/43
6,318,840 B1 * 11/2001 Sette ..... B41J 3/543 400/82
6,783,209 B2 * 8/2004 Gompertz ..... B41J 2/165 347/29
7,086,716 B2 * 8/2006 Steinfield ..... B41J 3/543 347/29
9,315,027 B1 * 4/2016 Kalb ..... B41J 2/16508
(Continued)

FOREIGN PATENT DOCUMENTS

KR 10-2011-0002684 1/2011
KR 10-2012-0018970 3/2012
(Continued)

*Primary Examiner* — Jason S Uhlenhake
(74) *Attorney, Agent, or Firm* — KILE PARK REED & HOUTTEMAN PLLC

(57) ABSTRACT

Disclosed is a method of controlling an inkjet printing process. According to one embodiment of the present invention, a method of controlling an inkjet printing process by using an inkjet print system, the method including a printing operation of moving a first support chuck or a second support chuck in a second direction perpendicular to a first direction and performing the inkjet printing process of discharging an ink onto a substrate and a first suction operation of suctioning remaining ink from a nozzle formed on a first head or a second head using a first suction unit, wherein a controller controls the printing operation for a first substrate, the first suction operation for the second head or the printing operation for a second substrate, and the first suction operation for the first head to be sequentially performed.

5 Claims, 4 Drawing Sheets

(56) References Cited

U.S. PATENT DOCUMENTS

| | | | | |
|---|---|---|---|---|
| 2003/0137550 | A1* | 7/2003 | Baiges | B41J 3/543<br>347/20 |
| 2009/0304916 | A1* | 12/2009 | Nakajima | G02F 1/1309<br>427/140 |

FOREIGN PATENT DOCUMENTS

| | | |
|---|---|---|
| KR | 10-2017-0003756 | 1/2017 |
| KR | 10-1968139 | 4/2019 |

* cited by examiner

METHOD OF CONTROLLING INKJET PRINTING PROCESS

CROSS-REFERENCE TO RELATED APPLICATION

This application claims priority to and the benefit of Korean Patent Application No. 10-2021-0040858, filed on Mar. 30, 2021, the disclosure of which is incorporated herein by reference in its entirety.

BACKGROUND

1. Field of the Invention

The present invention relates to a method of controlling an inkjet printing process, and more specifically, to a method of controlling an inkjet printing process which improves productivity.

2. Discussion of Related Art

As inkjet technologies are developed, the inkjet technologies are used in various fields in which not only text and the like are printed on paper, but liquid droplets such as an ink and the like are also discharged to form thin films or patterns to be used in manufacturing processes of display devices.

In an inkjet print system using the inkjet technology, it is important to prevent a nozzle of an inkjet print head from being blocked in an inkjet printing process and to exactly form a desired pattern on a substrate.

Since pattern forming quality of the inkjet print system is directly related to an ink discharge state of a head which discharges an ink, a maintenance process of consistently maintaining and managing an optimum ink discharge state of the head is required in each predetermined period during a printing process.

The maintenance process is variously configured according to an objective of quality control. The maintenance process includes capping for blocking an end portion of a nozzle in order to block the nozzle formed in a head from the outside when a printing process is not being performed, suctioning and wiping for removing foreign matters such as remaining ink on the end portion of the nozzle, and purging for trying to discharge an ink through the nozzle before the printing process is performed, and frequencies and periods of the individual maintenance processes are different.

In an inkjet printing process, before a next process is performed, time for position shift, process condition setting, and the like is required. In the inkjet printing process, when a series of processes including the printing process and the maintenance processes is performed intermittently, the printing process and the maintenance processes act as a variable causing a problem of a lag time, which increases a time for the printing process and decreases a manufacturing yield.

In the conventional inkjet print system, a maintenance process is spatially separately performed from a printing process, and the maintenance process and the printing process are performed in a maintenance region and a printing region, respectively.

In order to perform a specific maintenance process while the printing process is performed, a head needs to move to the maintenance region, and time for the printing process is increased by the physical movement time, and thus there is a problem of decreasing a manufacturing yield.

RELATED ART

Patent Document (Patent Document 0001) Korean Registration Publication No. 10-1968139 (Date of publication: Apr. 12, 2019)

SUMMARY OF THE INVENTION

The present invention is directed to providing a method of controlling an inkjet printing process capable of decreasing a tact time for a printing process to increase a manufacturing yield.

The present invention provides a method of controlling an inkjet printing process in order to solve the technical problem.

According to an aspect of the present invention, there is provided a method of controlling an inkjet printing process by using an inkjet print system that includes a first section including a first support chuck and a second support chuck, which support different substrates, and a first suction unit, a second section provided parallel to the first section in a first direction and including a second suction unit and a wiper, a first gantry which moves a position of a first head along the first section and the second section in the first direction, a second gantry which moves a position of a second head along the first section and the second section in the first direction independently of the first gantry, and a controller which drives the first support chuck, the second support chuck, the first suction unit, the second suction unit, the wiper, the first head, the second head, the first gantry, and the second gantry, the method including a printing operation of moving the first support chuck or the second support chuck in a second direction perpendicular to the first direction and performing an inkjet printing process of discharging an ink onto the substrate and a first suction operation of suctioning remaining ink from a nozzle formed on the first head or the second head using the first suction unit, wherein the controller controls the printing operation for a first substrate, the first suction operation for the second head or the printing operation for a second substrate, and the first suction operation for the first head to be sequentially performed.

The method may further include a substrate loading/unloading operation of unloading the first substrate from the first support chuck and loading a third substrate on the first support chuck, wherein, in the substrate loading/unloading operation, the controller may perform the first suction operation and, at the same time, control the first substrate to be unloaded from the first support chuck and the third substrate to be loaded on the second support chuck.

The first suction operation for the second head may be controlled to be sequentially performed after the first suction operation for the first head is performed.

The method may further include a second suction operation of suctioning remaining ink from the nozzle formed on the first head or the second head using the second suction unit, wherein the controller may control the second suction operation to be performed intermittently and the second suction unit to be driven according to the preset number of times that the printing operation is performed and whether an abnormality of the first head or the second head is detected.

The method may further include a first suction unit movement operation of moving a position of the first suction unit in a third direction perpendicular to the first direction and the second direction, wherein the controller may control the first suction unit movement operation of moving the first suction unit in the third direction to be performed at the same time as the printing operation.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, exemplary embodiments of the present invention will be described in detail with reference to the accompanying drawings. However, the technical spirit of the present invention is not limited to the embodiments which will be described in this specification and may be realized with different forms. Further, the embodiments introduced in this specification are provided so that the disclosed content is thorough and complete and the spirit of the present invention is sufficiently conveyed to those skilled in the art.

In the present specification, when a certain component is described as being present on another component, it means that the component may be directly disposed on another component, or a third component may be interposed therebetween. In addition, in the accompanying drawings, shapes and sizes are exaggerated to effectively describe the technical content.

In addition, although the terms "first," "second," "third," and the like are used herein to describe various elements in the various embodiments of the present specification, these elements should not be limited by these terms. These terms are only used to distinguish a certain element from another element. Accordingly, an element described as a first element in any one embodiment may be described as a second element in another embodiment. The embodiments described and illustrated in this specification include complementary embodiments thereof. In addition, the term "and/or" is used to include at least any one of elements listed therebefore and thereafter.

The singular forms are intended to include the plural forms, unless the context clearly indicates otherwise. In addition, the terms "comprise," "include," or the like specify the presence of features, numbers, steps, operations, elements, or combinations thereof which are described in the specification, but do not preclude the presence or addition of one or more other features, numbers, steps, operations, elements, or combinations thereof. In addition, in this specification, the term "connect" is used to include both indirect and direct connection of a plurality of elements.

In addition, in the following description, when it is determined that detailed descriptions of related well-known functions or configurations unnecessarily obscure the gist of the present invention, the detailed descriptions thereof will be omitted.

Hereinafter, for the sake of convenience in the description, a first direction corresponds to an X-axis in an orthogonal coordinate system, a second direction corresponds to a Y-axis in the orthogonal coordinate system, and a third direction corresponds to a Z-axis in the orthogonal coordinate system. In this case, the first direction is perpendicular to the second direction and the third direction.

Figure 1:
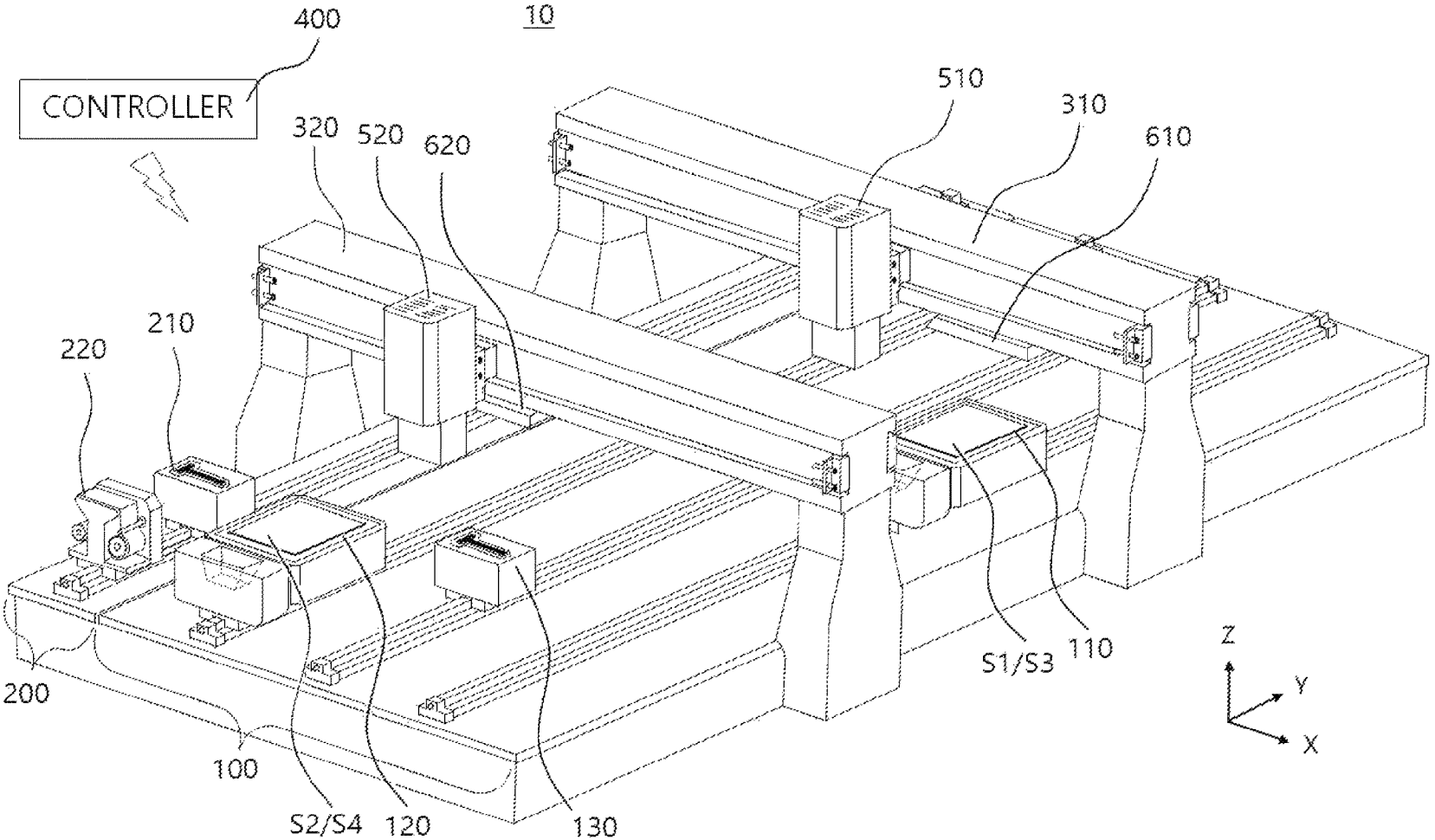
FIG. 1 is a schematic perspective view illustrating an inkjet printing process according to one embodiment of the present invention.
Figure 2:
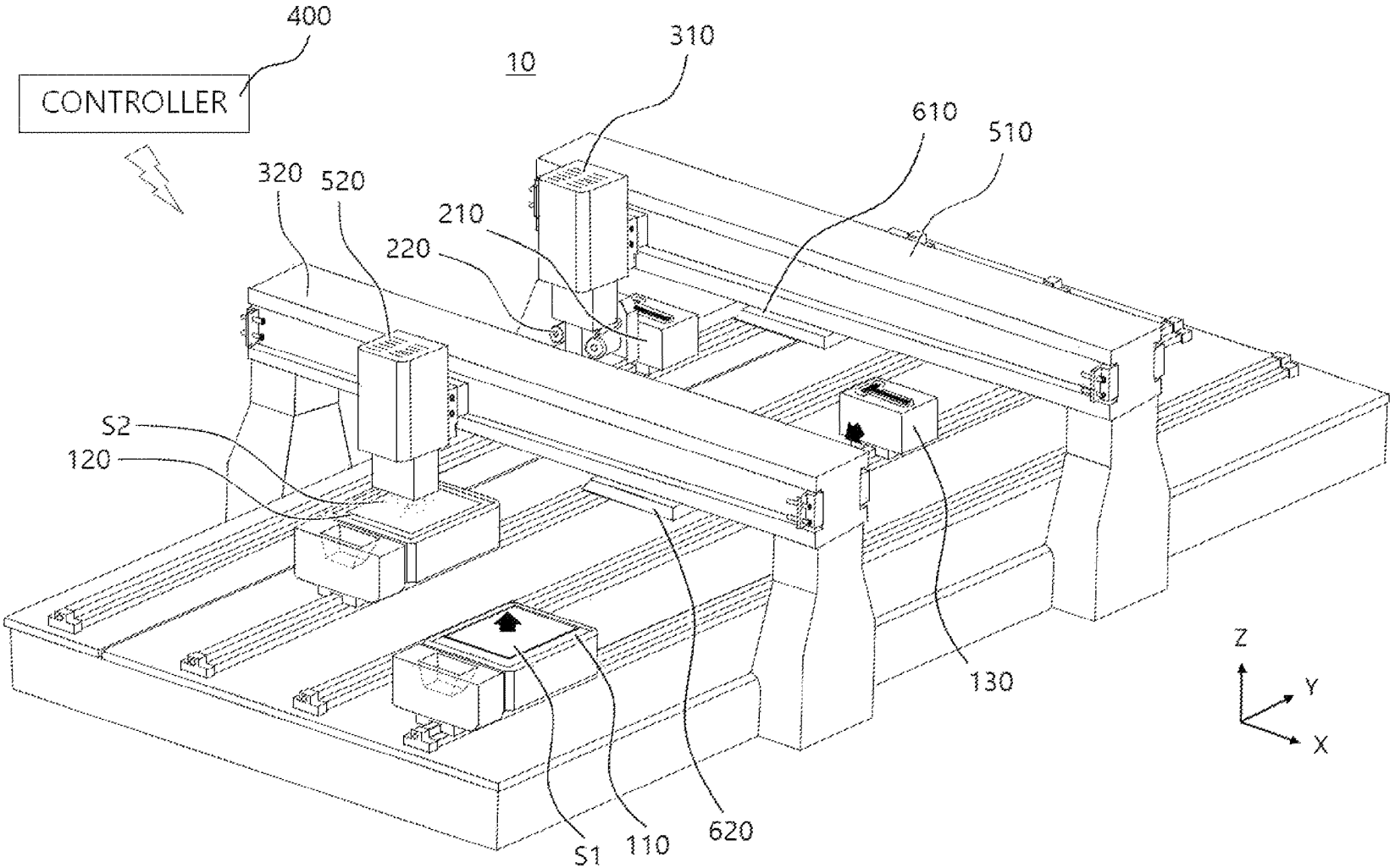
FIGS. 2 and 3 are perspective views illustrating operation states of the inkjet printing process according to time series according to one embodiment of the present invention.
Figure 3:
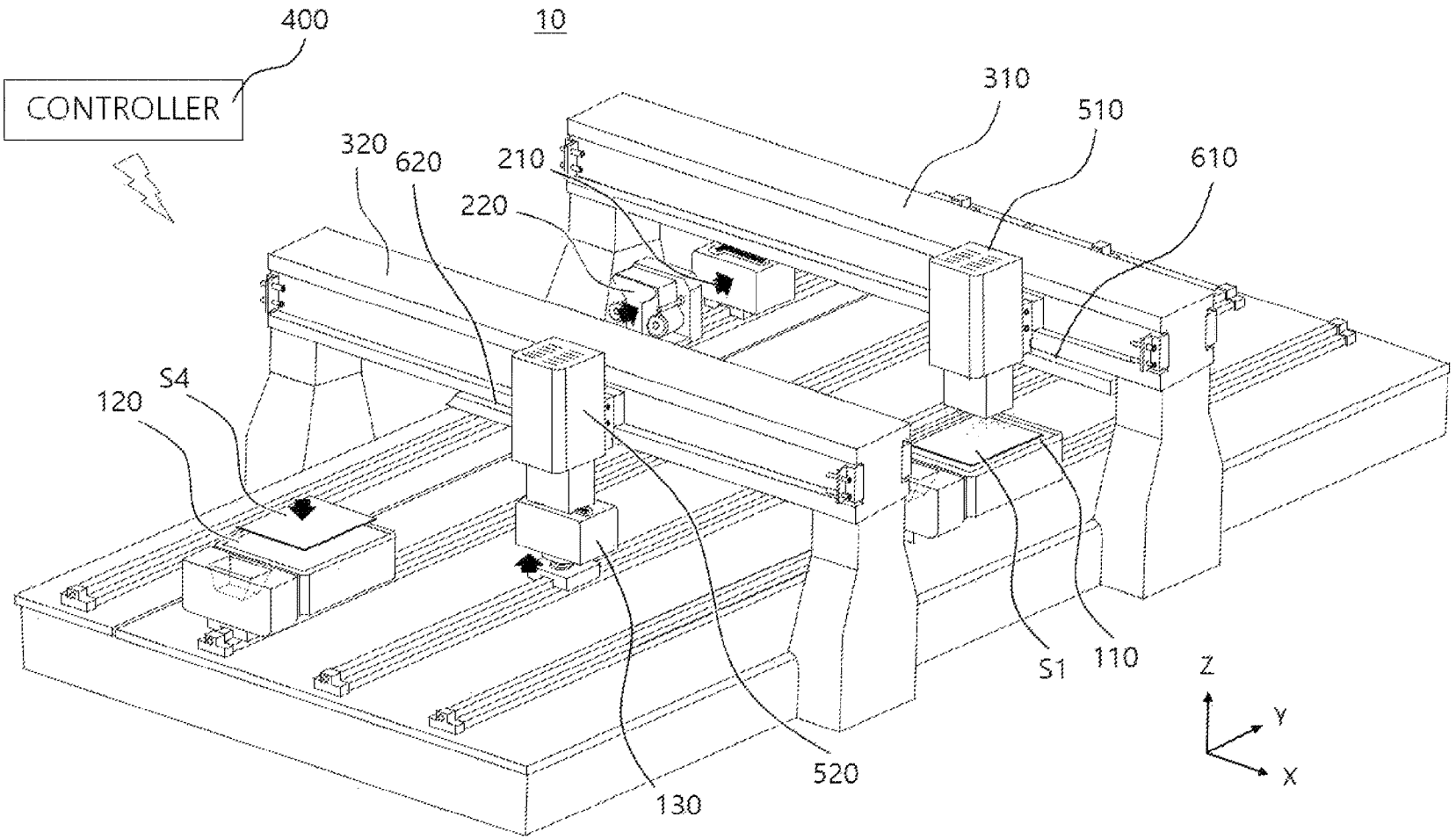
Figure 4:
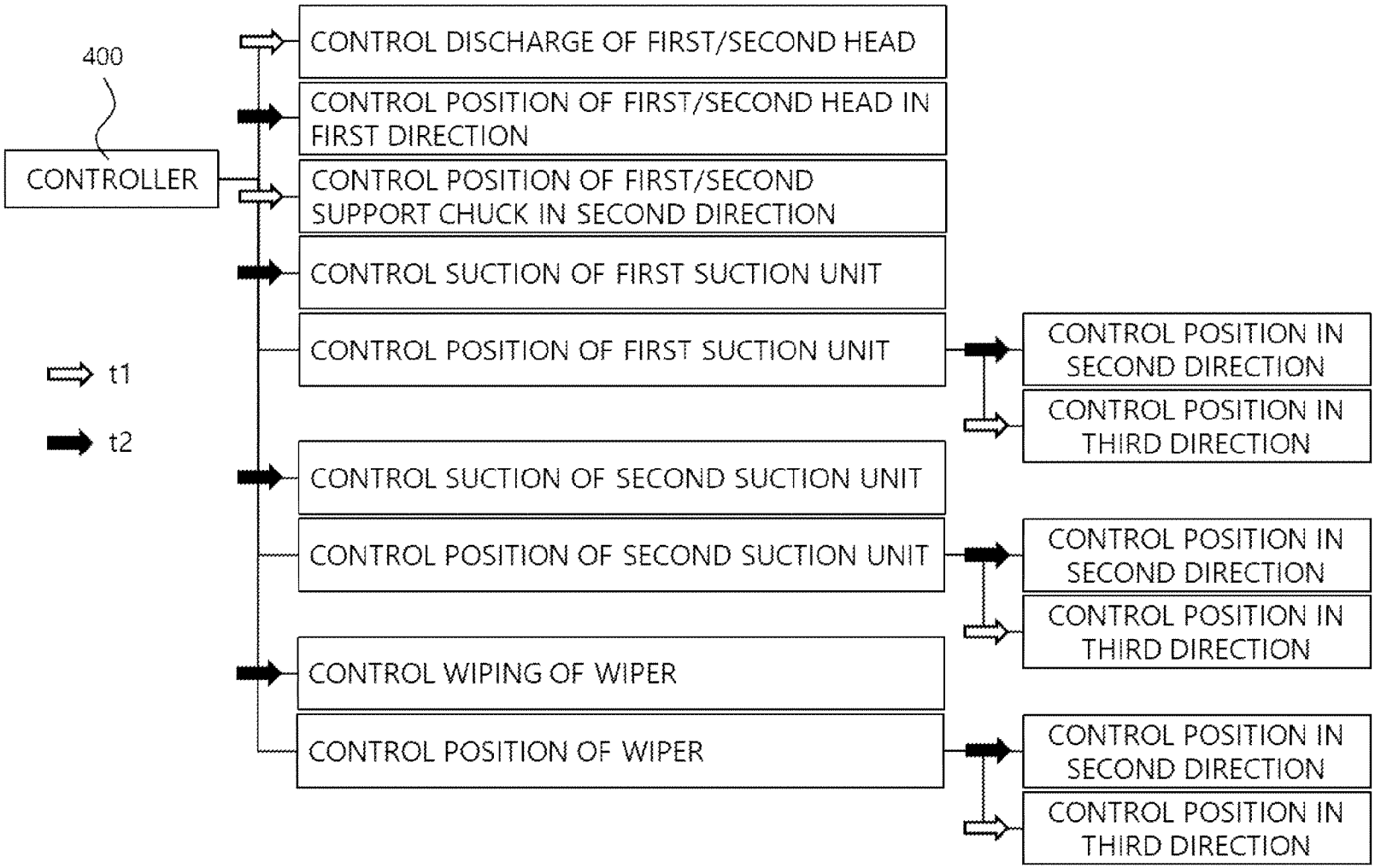
FIG. 4 is a block diagram showing a driving control relationship diagram of a controller according to one embodiment of the present invention.

FIG. 1 is a schematic perspective view illustrating an inkjet printing process according to one embodiment of the present invention, FIGS. 2 and 3 are perspective views illustrating operation states of the inkjet printing process according to time series according to one embodiment of the present invention, and FIG. 4 is a block diagram showing a driving control relationship diagram of a controller 400 according to one embodiment of the present invention.

Hereinafter, operations constituting a method of controlling an inkjet print process according to one embodiment of the present invention will be described in detail according to time series.

Referring to FIGS. 1 to 4, in the inkjet printing process according to one embodiment of the present invention, by allowing a printing process and a maintenance process, which are performed in different periods, to be concurrently performed in the same time zone, a time for the processes may be decreased greatly. An inkjet print system 10 may be formed to implement the method of controlling an inkjet printing process.

The inkjet print system 10 may include a first section 100, a second section 200, a first gantry 310, a second gantry 320, and the controller 400.

Referring back to FIGS. 1 to 3, the inkjet print system 10 including two heads 510 and 520 in a dual type so that patterns may be formed on different substrates S1 to S4 is disclosed. That is, in the inkjet print system 10, since the different heads 510 and 520 share a first suction unit 130, a second suction unit 210, and a wiper 220 which will be described below, a maintenance process may be selectively performed on any one head 510 or 520 of the dual heads 510 and 520, and the inkjet printing process may be independently performed in a dual manner. However, the present invention is not limited to the dual manner, and a layout or combination of components capable of performing the printing process and the maintenance process may vary.

Referring back to FIG. 1, in the first section 100, the dual printing process and some maintenance processes may be performed. In the first section 100, a first support chuck 110, a second support chuck 120, and the first suction unit 130 may be provided.

Referring back to FIGS. 1 to 3, the first support chuck 110 may support the substrate, that is, a first substrate S1 or third substrate S3. After a printing process is performed on the first substrate S1, when the first substrate S1 is unloaded, the third substrate S3 on which the printing process needs to be performed may be loaded on and supported by the first support chuck 110.

The first support chuck 110 may be provided perpendicular to the first gantry 310 disposed in the first direction.

Referring back to FIGS. 1 to 3, the second support chuck 120 may support the substrate, that is, a second substrate S2 or fourth substrate S4. After the printing process is performed on the second substrate S2, when the second substrate S2 is unloaded, the fourth substrate S4 on which the printing process needs to be performed may be loaded on and supported by the second support chuck 120.

An ink discharged through nozzles (not shown) may be applied on the substrates S1 to S4 to form patterns. The substrates S1 to S4 may have various sizes and shapes, and the sizes may be smaller than or equal to a size of the first support chuck 110 or the second support chuck 120.

Referring back to FIGS. 1 to 3, the first suction unit 130 may be provided parallel to the first support chuck 110 and the second support chuck 120 in the first direction. The first suction unit 130 may suction and remove remaining ink in the nozzle (not shown) of an end portion of the first head 510 or the second head 520 after the printing process is performed.

The first suction unit 130 may be controlled to serially operate after the printing operation of the first head 510 or the second head 520 is performed.

Referring back to FIGS. 1 to 3, a maintenance process may be performed in the second section 200. The second section 200 may be provided at one side of and parallel to the first section 100 in the first direction. In the second section 200, the second suction unit 210 and the wiper 220 may be provided.

In one embodiment according to FIGS. 1 to 3, in the first direction, a case in which the second section 200 is positioned at a left side of the first section 100 is illustrated, but the present invention is not limited thereto, and the second section 200 may be disposed to be provided at both sides, that is, the left side and a right side.

Referring back to FIGS. 1 to 3, the second suction unit 210 may be provided parallel to the first support chuck 110 and the second support chuck 120 in the first direction. The second suction unit 210 may suction and remove remaining ink in the nozzle (not shown) of the end portion of the first head 510 or the second head 520 after the printing process is performed.

The second suction unit 210 may be controlled to be driven to intermittently operate by the controller 400 after the printing operation of the first head 510 or the second head 520 is performed a plurality of times.

Referring back to FIGS. 1 to 3, the wiper 220 may come into contact with an end portion of the nozzle to remove ink and remove remaining ink from nozzles (not shown) of the end portions of the heads 510 and 520. The wiper 220 may be provided parallel to the second suction unit 210 in the second direction.

Referring back to FIGS. 1 to 3, the first gantry 310 may support the first head 510 and a first ultraviolet (UV) curing unit 610. The first gantry 310 may move positions of the first head 510 and the first UV curing unit 610 along the first section 100 and the second section 200 in the first direction. The first gantry 310 may independently provide moving paths of the first head 510 and the first UV curing unit 610 in the first direction.

The first gantry 310 may support the first head 510 to be movable in the first direction. That is, by driving control of the controller 400, a position of the first head 510 may be fixed on the first gantry 310 in the second direction and moved to an arbitrary position in the first direction. The position of the first head 510 according to one embodiment may be fixed in the second direction and positioned on the first section 100 or the second section 200 in the first direction.

Referring back to FIGS. 1 to 3, the first head 510 may discharge an ink on the first substrate S1 or the third substrate S3.

In the first head 510, several tens to several thousands of nozzles (not shown) may be formed. The first head 510 may include an ink supply unit (not shown) on an ink discharge path through which the ink is supplied to the nozzles (not shown).

The nozzles (not shown) may discharge the fine ink in a liquid droplet type. The nozzles (not shown) may be consistently maintained and managed through at least any one maintenance process among a first suction operation, a second suction operation, and a wiping operation so that the ink is smoothly discharged in the printing operation.

The first UV curing unit 610 may emit UV light to liquid droplets applied on the first substrate S1 and cure the liquid droplets. Curing is a process of reducing fluidity of the liquid droplets having a liquid phase form to minimize deformation.

The first UV curing unit 610 may be provided to be installed on the first gantry 310 independently of the first head 510.

The first UV curing unit 610 may be controlled by the controller 400 to be driven to emit the UV light at the same time as or a different time from the printing process.

In addition, the first UV curing unit 610 may be controlled by the controller 400 to be driven to perform a curing operation and the first suction operation of the first suction unit 130 in parallel.

Referring back to FIGS. 1 to 3, the second gantry 320 may support the second head 520 and a second UV curing unit 620. The second gantry 320 may move positions of the second head 520 and the second UV curing unit 620 along the first section 100 and the second section 200 in the first direction. The second gantry 320 may independently provide moving paths of the second head 520 and the second UV curing unit 620 in the first direction.

The second gantry 320 may be provided to be spaced apart from and parallel to the first gantry 310.

Referring back to FIGS. 1 to 4, the controller 400 may control operation of at least any one among the first support chuck 110, the second support chuck 120, the first suction unit 130, the second suction unit 210, the wiper 220, the first head 510, the second head 520, the first gantry 310, the second gantry 320, the first UV curing unit 610, and the second UV curing unit 620 to be driven. Particularly, the controller 400 may adjust an operation time and the number of operations in the inkjet printing process so that the inkjet printing process including the maintenance process is sequentially performed on the plurality of substrates S1 to S4 and thus may control the first support chuck 110, the second support chuck 120, the first suction unit 130, the second suction unit 210, the wiper 220, the first head 510, the second head 520, the first gantry 310, the second gantry 320, the first UV curing unit 610, and the second UV curing unit 620 to be driven independently of each other.

The controller 400 may control a use frequency of the first suction unit 130 to be different from that of the second suction unit 210 or the wiper 220.

In addition, the controller 400 may control a discharge amount per unit time, the number of times that discharge is performed at an arbitrary position, or the like in units of nozzles of the first head 510 or the second head 520.

The controller 400 may control an operation state of the first UV curing unit 610 or the second UV curing unit 620 by adjusting a UV emission time and a magnitude of UV light at an arbitrary position. That is, the controller 400 may control a degree of a change in volume of the liquid droplets according to a discharge amount of the first head 510 or the second head 520 and/or a degree of a change in volume of the liquid droplets according to a degree of curing of the first UV curing unit 610 or the second UV curing unit 620.

The first head 510 and the second head 520 may be provided in a dual type.

A method of controlling an inkjet printing process using the above inkjet print system may include a printing operation and a first suction operation, and in addition, may further include a substrate loading/unloading operation, a second suction operation, and a first suction unit movement operation.

In the printing operation, an inkjet printing process of discharging an ink in order to form a pattern on the first substrate S1 or the third substrate S3 provided on the first support chuck 110 or the second substrate S2 or the fourth substrate S4 provided on the second support chuck 120 may be performed.

In the printing operation, a position of the first support chuck 110 on which the first substrate S1 or the third substrate S3 is loaded may be moved in the second direction, and the first head 510 may discharge the ink onto the first substrate S1 or the third substrate S3.

Similarly, in the printing operation, a position of the second support chuck 120 on which the second substrate S2 or the fourth substrate S4 is loaded may be moved in the second direction, and the second head 520 may discharge the ink onto the second substrate S2 or the fourth substrate S4.

In the first suction operation, the first suction unit 130 may suction and remove remaining ink from the nozzles (not shown) formed on the first head 510 or the second head 520.

The controller 400 may control the first head 510, the second head 520, and the first suction unit 130 so that the first suction operation for the second head 520 is sequentially performed after the first suction operation for the first head 510 is performed.

The controller 400 may control the printing operation for the first substrate S1, the first suction operation for the second head 520 or the printing operation for the second substrate S2, and the first suction operation for the first head 510 to be sequentially performed.

The printing process operation performed by the first head 510 may be controlled by the controller 400 to be performed at a different time from the printing process operation performed by the second head 520.

The first suction operation for the first head 510 may be controlled by the controller 400 to be performed at a different time from the second suction operation for the second head 520.

The first suction operation may be controlled by the controller 400 to be performed at the same time as a substrate unloading operation for the first substrate S1 or the second substrate S2 and/or a substrate loading operation for the third substrate S3 or the fourth substrate S4.

In the second suction operation, the second suction unit 210 may suction and remove remaining ink from the nozzle (not shown) formed on the first head 510 or the second head 520. The second suction operation may be controlled by the controller 400 to be performed in a different period from the first suction operation.

According to one embodiment, the first suction operation is controlled by the controller 400 to be sequentially performed with the printing operation, or the second suction operation may be controlled by the controller 400 to be performed intermittently. That is, in the second suction operation, the controller 400 may control the second suction unit 210 to be driven according to a plurality of preset times that the printing operation is performed or detection of an abnormality of the first head 510 or the second head 520.

The detection of the abnormality of the first head 510 or the second head 520 may be checked by a monitoring unit (not shown) such as a camera provided on the inkjet print system and transmitted to the controller 400.

In the substrate loading/unloading operation, the first substrate S1 on which the printing process is completely performed may be unloaded from the first support chuck 110, the second substrate S2 on which the printing process is completely performed may be unloaded from the second support chuck 120, the third substrate S3 on which the printing process needs to be performed may be loaded on the first support chuck 110, or the fourth substrate S4 on which the printing process needs to be performed may be loaded on the second support chuck 120.

The substrate loading/unloading operation may be controlled by the controller 400 to be performed at the same time as the first suction operation or the second suction operation.

In the first suction unit movement operation, a position of the first suction unit 130 may be moved in the third direction.

The first suction unit movement operation may be controlled by the controller 400 to be performed at the same time as the printing operation. That is, the first suction unit movement operation may be controlled by the controller 400 so that the first suction unit 130 is positioned in the third (+) direction in a direction parallel to the first head 510 or the second head 520 before the first suction operation for the first head 510 or the second head 520 is performed after the printing operation is performed.

The controller may control positions of the first suction unit 130, the second suction unit 210, and the wiper 220 to be moved in the third direction to be parallel to or spaced apart from a level of the first head 510 or the second head 520.

The controller 400 may control the different processes to be sequentially performed.

Referring back to FIG. 2, in the method of controlling an inkjet printing process according to one embodiment, the wiping operation may be performed by the wiper 220 after the printing operation is performed on the first substrate S1. The printing operation may also be performed on the second substrate S2 loaded on the second support chuck 120 by the second head 520 at the same time. The printing operation and a first suction unit position movement operation of moving the first suction unit 130 to a position parallel to the second gantry 320 may be performed at the same time.

More specifically, the controller 400 may allow the printing operation and a wiper movement operation to be performed so that the position of the wiper 220 is moved in the third (+) direction at the same time. In this case, the wiping operation may be performed just after the second suction operation is performed by the second suction unit 210 or the printing operation is performed.

The wiping operation may be performed by the wiper 220. The printing operation may also be performed on the second substrate S2 loaded on the second support chuck 120 by the second head 520 at the same time.

More specifically, the controller 400 may allow the wiper movement operation to be performed so that the wiper 220 is positioned in the third (+) direction at the same time as the printing operation. In this case, the wiping operation may be performed just after the second suction operation is performed by the second suction unit 210 or the printing operation is performed.

Referring back to FIG. 3, in the method of controlling an inkjet printing process according to one embodiment, the substrate loading/unloading operation of unloading the second substrate S2 and loading the fourth substrate S4 may be performed after the printing operation is performed on the second substrate S2. The substrate loading/unloading operation and the first suction operation by the first suction unit 130 may be performed at the same time.

The controller 400 may perform the printing operation on the fourth substrate S4 after the first suction operation is performed.

According to an embodiment of the present invention, since a controller controls different processes to be performed at the same time, there is an advantage of greatly decreasing a processing time.

According to one embodiment of the present invention, although a first suction unit, a second suction unit, and a wiper are not provided to correspond to the number of the plurality of heads, since the controller interchangeably controls a printing process and a suction process, there is an advantage of improving process performance so that the processes do not overlap and the processes are sequentially performed in a shortest time.

According to another embodiment of the present invention, since positions of a first suction unit, a second suction unit, and a wiper can be moved in a third direction, a load of moving a position of a head is reduced, the positions are moved in the third direction at the same time as a printing operation of the head, and thus there is an advantage of reducing workloads of the head and a gantry.

Although the present invention has been described in detail through the exemplary embodiments, the scope of the present invention is not limited to the detailed description but should be interpreted based on the appended claims. In addition, those skilled in the art will understand that many modifications and variations are possible without departing from the scope of the present invention.

What is claimed is:

1. A method of controlling an inkjet printing process by using an inkjet print system that includes a first section including a first support chuck and a second support chuck, which support different substrates, and a first suction unit, a second section provided parallel to the first section in a first direction and including a second suction unit and a wiper, a first gantry which moves a position of a first head along the first section and the second section in the first direction, a second gantry which moves a position of a second head along the first section and the second section in the first direction independently of the first gantry, and a controller which drives the first support chuck, the second support chuck, the first suction unit, the second suction unit, the wiper, the first head, the second head, the first gantry, and the second gantry, the method comprising:

a printing operation of moving the first support chuck or the second support chuck in a second direction perpendicular to the first direction and performing an inkjet printing process of discharging an ink onto the substrate; and a first suction operation of suctioning remaining ink from a nozzle formed on the first head or the second head using the first suction unit, wherein the controller controls the printing operation for a first substrate, the first suction operation for the second head or the printing operation for a second substrate, and the first suction operation for the first head to be sequentially performed.

2. The method of claim 1, further comprising a substrate loading/unloading operation of unloading the first substrate from the first support chuck and loading a third substrate on the first support chuck, wherein, in the substrate loading/unloading operation, the controller performs the first suction operation and, at the same time, controls the first substrate to be unloaded from the first support chuck and the third substrate to be loaded on the second support chuck.

3. The method of claim 1, wherein the controller controls the first suction operation for the second head to be sequentially performed after the first suction operation for the first head is performed.

4. The method of claim 1, further comprising a second suction operation of suctioning remaining ink from the nozzle formed on the first head or the second head using the second suction unit, wherein the controller controls the second suction operation to be performed intermittently and the second suction unit to be driven according to a preset number of times that the printing operation is performed and whether an abnormality of the first head or the second head is detected.

5. The method of claim 1, further comprising a first suction unit movement operation of moving a position of the first suction unit in a third direction perpendicular to the first direction and the second direction, wherein the controller controls the first suction unit movement operation of moving the first suction unit in the third direction at the same time as the printing operation.

* * * * *